US010840004B2

(12) United States Patent
Goodrich

(10) Patent No.: US 10,840,004 B2
(45) Date of Patent: Nov. 17, 2020

(54) REDUCING RELUCTANCE IN MAGNETIC DEVICES

(71) Applicant: Hamilton Sundstrand Corporation, Charlotte, NC (US)

(72) Inventor: Timothy Arn Goodrich, Rockford, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 16/111,089

(22) Filed: Aug. 23, 2018

(65) Prior Publication Data

US 2020/0066434 A1 Feb. 27, 2020

(51) Int. Cl.
*H01F 27/24* (2006.01)
*H01F 27/28* (2006.01)

(52) U.S. Cl.
CPC ..... *H01F 27/24* (2013.01); *H01F 27/28* (2013.01)

(58) Field of Classification Search
CPC ..... H01F 27/00; H01F 27/24; H01F 27/28; H01F 27/32; H01F 2038/305; G05F 1/325
See application file for complete search history.

(56) References Cited

U.S. PATENT DOCUMENTS 4,653,460 A 3/1987 Ooyabu et al.
5,065,073 A * 11/1991 Frus ..... F02P 3/0869 123/634
5,692,483 A 12/1997 Wada et al.
6,512,438 B1 * 1/2003 Yoshimori ..... H01F 17/062 336/178
6,992,555 B2 1/2006 Hasegawa et al.
2002/0024413 A1 * 2/2002 De Graaf ..... H01F 3/14 336/213
2007/0080769 A1 * 4/2007 Thiel ..... H01F 3/14 336/65
2007/0090916 A1 4/2007 Rao
2009/0079532 A1 3/2009 Muelleman
2009/0146769 A1 6/2009 Feng et al.
2014/0218012 A1 8/2014 Umetani
(Continued)

FOREIGN PATENT DOCUMENTS

WO WO-2004070739 A2 8/2004
WO WO-2014091589 9/2014
WO WO-2017208745 12/2017

OTHER PUBLICATIONS

Extended European Search Report for European Patent Application No. EP19192825.8, dated Nov. 21, 2019.
(Continued)

*Primary Examiner* — Gary L Laxton
(74) *Attorney, Agent, or Firm* — Locke Lord LLP; Scott D. Wofsy; Judy R. Naamat

(57) ABSTRACT

A magnetic core for inductor includes a first core segment, a second core segment spaced apart from the first core segment by a gap, and a spacer. The spacer is arranged within the gap and between the first core segment and the second core segment. The spacer includes a semi-conductive material to limit arc radius of magnetic flux lines communicated between the first core segment and the second core segment outside the gap. Inductors, flyback transformers and transformer rectifier units, and power conversion methods are also described.

18 Claims, 5 Drawing Sheets

(56) References Cited

U.S. PATENT DOCUMENTS

2016/0301315 A1 10/2016 Pan et al.

OTHER PUBLICATIONS

Yiren, W., et al.: "Thermal management of compact nanocrystalline inductors for power dense converters", 2018 IEEE Applied Power Electronics Conference and Exposition (APEC), IEEE, Mar. 4, 2018 (Mar. 4, 2018), pp. 2696-2703, XP033347618, DOI: 10.1109/APEC.2018.8341398 [retrieved on Apr. 18, 2018].

Nagai, Y., et al.:: "Thermal Conductivity of Epoxy Resin Filled with Particulate Aluminum Nitride Powder", Journal of the Ceramic Society of Japan, vol. 105, No. 1219, 1997, pp. 197-200, XP055638874, JP ISSN: 0914-5400, DOI: 10.2109/jcersj.105.197.

Anonymous: "Magnetic core—Wikipedia", Wikipedia, Jun. 5, 2017 (Jun. 5, 2017), pp. 1-8, XP055514410, Retrieved from the Internet: URL:https://en.wikipedia.org/w/index.phptitle=Magnetic_core&oldid=783992097#SendustKoolMU [retrieved on Oct. 11, 2018].

* cited by examiner

10/12

102

300

REDUCING RELUCTANCE IN MAGNETIC DEVICES

BACKGROUND OF THE INVENTION

1. Field of the Invention

The present disclosure relates to electrical systems, and more particularly to electrical systems having inductors with gapped cores.

2. Description of Related Art

Inductors are electrical devices that store energy in a magnetic field responsive to current flow through the inductor. The magnetic field operates to oppose change in the current flow, generally according to the inductance of the particular inductor. In some applications a magnetic core is provided for magnetization by the current flowing through the inductor. As the core becomes increasingly magnetized the opposition to change in current flow provided by the core increases, generally until the core becomes saturated.

Some cores have gaps, such in electrical devices used to support higher currents. While gaps allow for higher current flows gaps generally lower the effective permeability of the inductor, typically resulting in lower inductance. Since lowering the effective permeability of the gap increases the losses associated with permeability of the magnetic core (as a function of the frequency of the current), gaps distance is typically selected to promote fringing, where the magnetic flux lines depart to the core on one side of the gap and return to the core on the opposite side of the gap. This increases inductance, offsetting some of the effects of the gap. However, fringing can result in radiated field cross talk in the windings proximate the gap as well as localized heating where the magnetic flux lines return to the magnetic core.

Such conventional methods and systems have generally been considered satisfactory for their intended purpose. However, there is still a need in the art for improved magnetic cores, inductors, and related methods. The present disclosure provides a solution for this need.

SUMMARY OF THE INVENTION

A magnetic core for inductor includes a first core segment, a second core segment spaced apart from the first core segment by a gap, and a spacer. The spacer is arranged within the gap and between the first core segment and the second core segment. The spacer includes a semi-conductive material to limit arc radius of magnetic flux lines communicated between the first core segment and the second core segment outside the gap.

In certain embodiments, the semi-conductive material has a relative permeability of about 1. The semi-conductive material can have electrical resistivity that is greater than electrical resistivity of aluminum. The semi-conductive material can include aluminum nitride. Arc radius of magnetic lines of flux entering the second core segment from the first core segment can be smaller than arc radius of magnetic flux entering the second core segment with an air spacer or aluminum spacer of substantially equivalent reluctance.

In accordance with certain embodiments, the spacer can be electrically isolated from the first core segment. The spacer can be electrically isolated from the second core segment. An insulator can be arranged between the spacer and the first core segment. The insulator can be a first insulator and a second insulator can be arranged between the spacer and the second core segment. The spacer can be thermally grounded. The spacer can be thermally grounded to the chassis of an electrical device including the magnetic core, such as a flyback transformer or a transformer rectifier unit by way of example.

It is also contemplated that, in accordance with certain embodiments, the magnetic core can have a toroid shape. The magnetic core can be monolithic in construction. The magnetic core can have a layered construction. The first core segment and the second core segment can include a ferromagnetic material. A winding can extend about the first core segment, the spacer, and the second core segment. Separation between the winding and the spacer can be substantially equivalent to spacing between the winding and at least one of the first core segment and the second core segment.

An inductor includes a magnetic core as described above. A first insulator is arranged between the spacer and the first core segment. A second insulator is arranged between the spacer and the second core segment. A thermal ground connects the second core segment to a heat sink through the spacer and the second insulator. A flyback transformer or transformer rectifier unit (TRU) can include the an inductor. The flyback transformer or TRU can be configured and adapted to convert 120 voltage alternating current power into 28 volt direct current power.

A power conversion method includes, at a magnetic core with a winding wrapped thereabout and a first core segment, a second core segment spaced apart from the first core segment by a gap, and a spacer including a semi-conductive material arranged in the gap and between the first and second core segments, inducing magnetic flux in the first core segment. The magnetic flux is communicated to the second core segment and arc radius of lines of magnetic flux returning to the second core segment limited with the semi-conductive material.

In certain embodiments arc radius of lines of magnetic flux returning to the second core segment from the first segment can be less than an air spacer or aluminum spacer of substantially equivalent reluctance. The spacer can be electrically separated from the second core segment with an insulator. Heat can be transferred from the location where the lines of magnetic flux return to the core through a heat sink thermally coupled to the second core segment by the spacer.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION OF THE PREFERRED EMBODIMENTS

Figure 1:
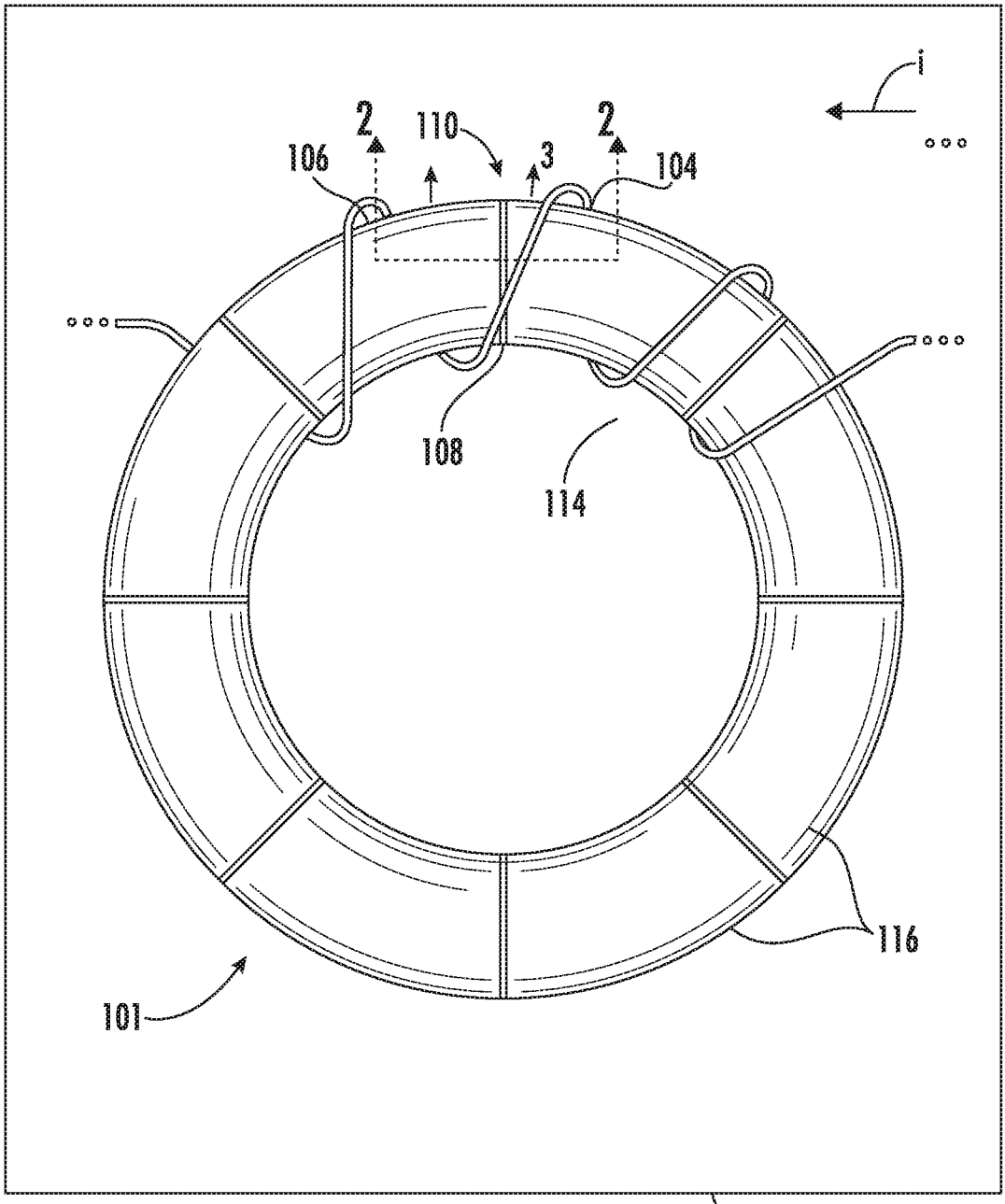
FIG. 1 is a plan view of an exemplary embodiment of an inductor constructed in accordance with the present disclosure, shown a winding wrapped about a segment magnetic core with gaps between the magnetic core segments.

Reference will now be made to the drawings wherein like reference numerals identify similar structural features or aspects of the subject disclosure. For purposes of explanation and illustration, and not limitation, a partial view of an exemplary embodiment of a magnetic core with a spacer formed from a semi-conductive material in accordance with the disclosure is shown in FIG. 1 and is designated generally by reference character 100. Other embodiments of magnetic cores, transformer rectifier units having ferromagnetic cores with segments spaced by semi-conductive materials, and power conversion methods in accordance with the disclosure, or aspects thereof, are provided in FIGS. 2-5, as will be described. The systems and methods described herein can be used in magnetic cores for inductors, such as in flyback transformers or transformer rectifier units for aircraft electrical systems, though the present disclosure is not limited to aircraft electrical systems or a particular type of electrical device in general.

Referring to FIG. 1, an inductor 102 is shown. Inductor 102 includes magnetic core 100. Magnetic core 100 includes a first core segment 104, a second core segment 106, and a spacer 108. Second core segment 106 is spaced apart from first core segment 104 by a gap 110 and spacer 108 is arranged with gap 110. Spacer 108 includes a semi-conductive material 112 (shown in FIG. 2) to limit arc radius 113 of magnetic flux lines M (shown in FIG. 2) communicated between first core segment 104 and second core segment 106 radially outward of gap 110.

A winding 114 is wrapped about at least a portion of magnetic core 100. Winding 114 carries a current i, which induces magnetic flux M (shown in FIG. 2). In certain embodiments winding 114 is part of flyback transformer 10. In accordance with certain embodiments winding 114 can be part of a transformer rectifier unit (TRU) 12, such as for an aircraft electrical system. In the illustrated exemplary embodiment magnetic core 100 has a toroid shape 116. Toroid shape 116 is defined by eight (8) core segments sequentially spaced apart from one another by eight (8) spacers. This is for illustration purposes only and is non-limiting. As will be appreciated by those of skill in the art in view of the present disclosure, magnetic core 100 can have fewer than eight segments or more than eight segments, as suitable for an intended application. As will also be appreciated by those of skill in the art in view of the present disclosure, magnetic core 100 can have another shape, such as a U-shape or an E-shape, and remain within the scope of the present disclosure.

Figure 2:
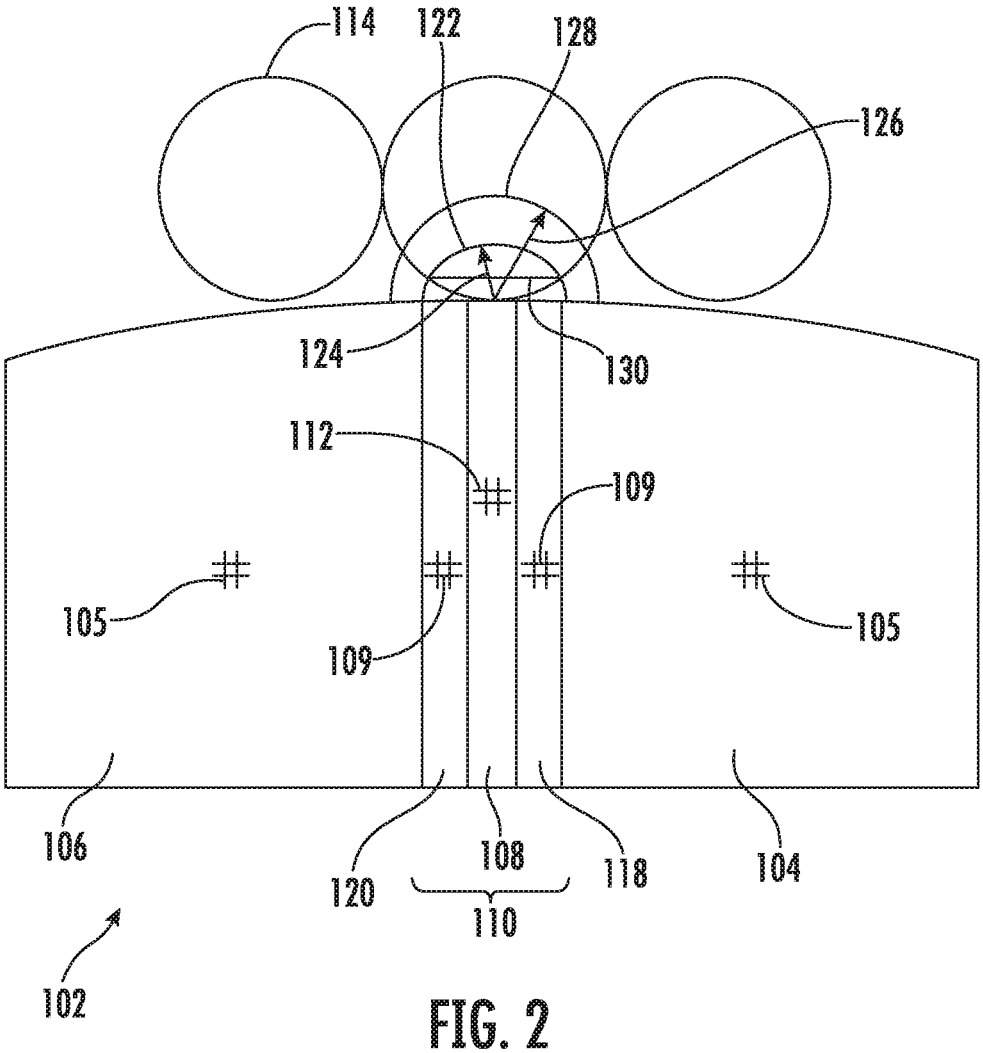
FIG. 2 is a plan view of a portion of the inductor of FIG. 1 including a spacer arranged within the gap between the core segments, showing arc radius of magnetic flux radiated outward from the gap in relation to ideal arc radius and arc radius of an air gap of equivalent reluctance.

With reference to FIG. 2, inductor 102 is shown. First core segment 104 and second core segment 106 each include a ferromagnetic material 105 (shown in FIG. 2). Spacer 108 is arranged within gap 110 between first core segment 104 and second core segment 106. Inductor 102 also includes a first insulator 118 and a second insulator 120. First insulator 118 is arranged within gap 110 between first core segment 104 and spacer 108. Second insulator 120 is also arranged within gap 110, and is additionally located between second core segment 106 and spacer 108. Winding 114 extends about first core segment 104, spacer 108, and second core segment 106.

It is contemplated that first insulator 118 and second insulator 120 each be formed from an insulator material 109 that is both a good electrical insulator, spacer 108 thereby being electrically isolated (i.e. electrically insulated) from first core segment 104 and second core segment 106. In certain embodiments insulator material 109 is a dielectric adhesive material, which facilitates fabrication of magnetic core 100 as well as providing suitable electrical isolation. Further, in accordance with certain embodiments, it is also contemplated that the material forming first insulator 118 and second insulator 120 each be formed from a material with a relatively good heat transfer coefficient for removing heat from second core segment 106, thereby limiting permeability variation due to heating as a consequence of magnetic flux M communicated radially outward from magnetic core 100 upon return to second core segment 106.

Spacer 108 includes semi-conductive material 112. In certain embodiments semi-conductive material 112 has a relative permeability of about 1. Relative permeability of about 1 enables spacer 108 to communicate sufficient flux therethrough that magnetic flux lines radiated radially outward from magnetic core 100 (illustrated schematically with a single magnetic flux 'mean' flux line 122) return to second core segment with an angle that is less than about 90 degrees. This reduces the return angle of magnetic flux lines 122, limiting so-called flux crowding in the exterior portion of second core segment 106 bounding spacer 108, and limiting localized hearing at the portion. In certain embodiments semi-conductive material 112 has an electrical resistivity that is greater than electrical resistivity of aluminum, which allows gap 110 to have a relatively small gap width. Semi-conductive material 112 can be, for example, aluminum nitride.

It is contemplated that the arc radius of magnetic lines of flux entering the second core segment from the first core segment can be smaller than arc radius of magnetic flux entering the second core segment with an air spacer or aluminum spacer of substantially equivalent reluctance. In this respect, as shown in FIG. 2, magnetic flux lines 122 have an arc radius 124 that is smaller than an arc radius 126 of magnetic flux lines 128 of an air gap spacer or a spacer used in the magnetic core 100 for purposes providing substantially the same reluctance at gap 110. While having arc radius greater than an ideal arc radius, e.g., a flat arc radius 130 (indicating no fringing flux in the vicinity of gap 110), it is contemplated that that magnetic flux lines 122 allow for positioning winding 114 at spacer 108 with equivalent radial separation as required at first core segment 104 and second core segment 106. This is because semi-conductive material 112 reduces magnitude of magnetic flux lines 122 such that eddy current formation on winding 114 is limited, and the associated cross talk relatively small.

Figure 3:
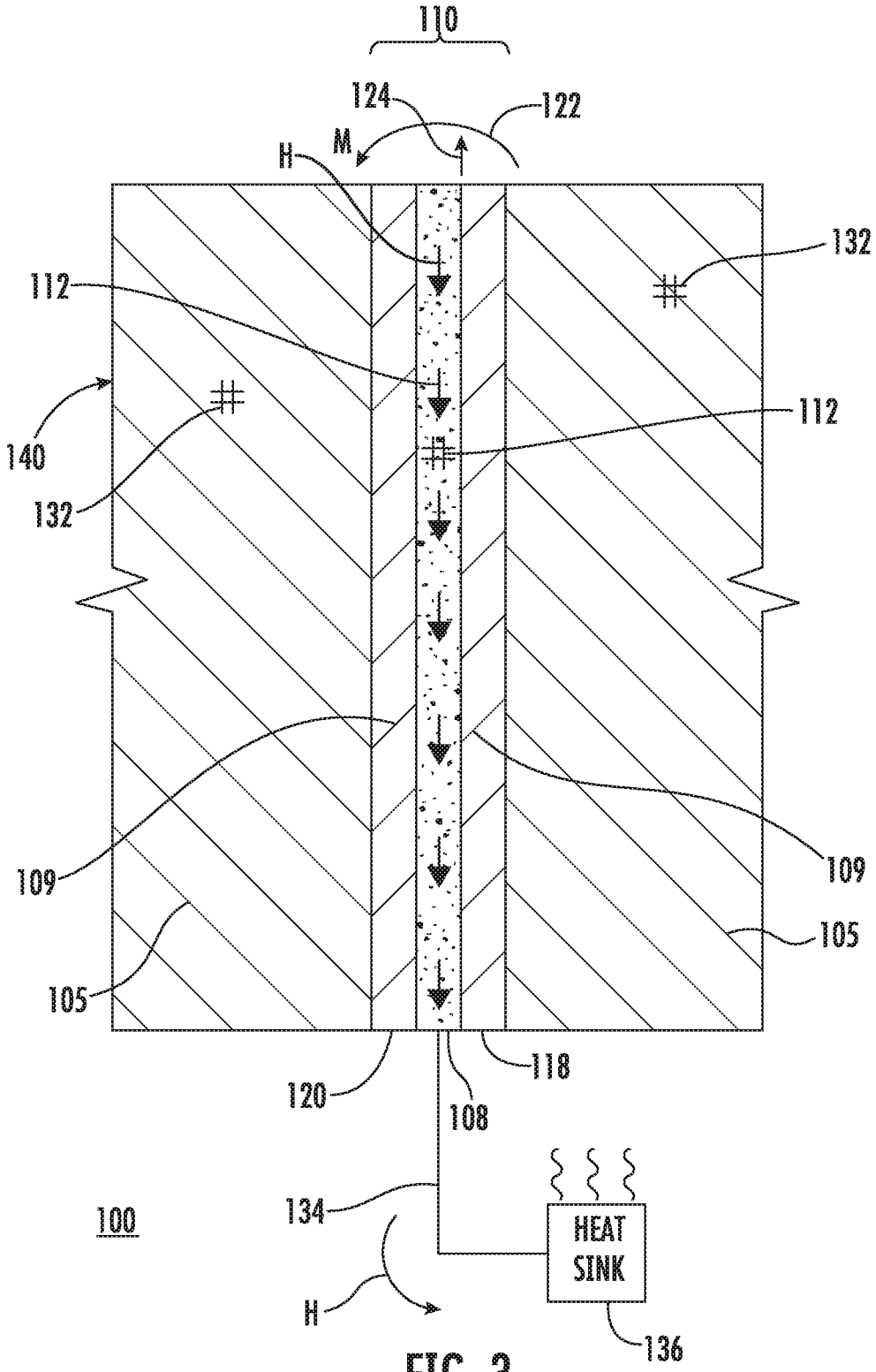
FIG. 3 is partial cross section view of the inductor of FIG. 1, showing insulators arranged within the gap and heat being communicated through a spacer arranged in the gap to a heat sink according to an exemplary embodiment having a monolithic core construction.

Referring now to FIG. 3, magnetic core 100 is shown according to an exemplary embodiment having a monolithic construction 140. As used herein the term monolithic means that magnetic core 100 does not include stacked layers and/or laminated sheets within its respective core segments. Instead, as shown in FIG. 3, ferromagnetic material 105 included in magnetic core 100 includes a material formed from ferrite or powdered metal 132. As will be appreciated by those of skill in the art in view of the present disclosure, use of powdered metal eliminates the intra-segment barrier that sheet interfaces can pose to magnetic flux communication, and the associated efficiency losses due to heating at such interfaces. This is because of the homogeneity provided by the monolithic construction of magnetic core 100 when constructed using ferrite or powdered metal 132.

As also shown in FIG. 3, magnetic core 100 is thermally grounded. In this respect inductor 102 includes a thermal ground 134 connecting second core segment 106 to a heat sink 136 through spacer 108 and second insulator 120. More particularly, thermal ground 134 is connected (i.e., thermally and electrically) directly to spacer 108. This allows heat H generated at the radially outer periphery of second core segment 106 to be communicated by second insulator 120 to spacer 108, and therethrough to heat sink 136 through thermal ground 134. Communicating heat H to heat sink 136 prevents H from locally changing permeability of magnetic core 100, which could otherwise offset at least in part the permeability homogeneity provided by ferrite or powdered metal 132. This is particularly the case at relative high current flow levels. Heat sink 136 can be, for example, a chassis of an electrical device, such as flyback transformer 10 (shown in FIG. 1) or TRU 12 (shown in FIG. 1) by way of example. In certain embodiments flyback transformer or TRU 10 is configured and adapted to convert 120 voltage alternating current power into 28 volt direct current power. However, as will be appreciated by those of skill in the art in view to the present disclosure, flyback transformers and TRU device with higher or lower ratings, as well as other electrical devices, can also benefit from the present disclosure due to the reduced weight of magnetic core 100 and lower operating temperature of inductor 102 associated with magnetic core 100.

Figure 4:
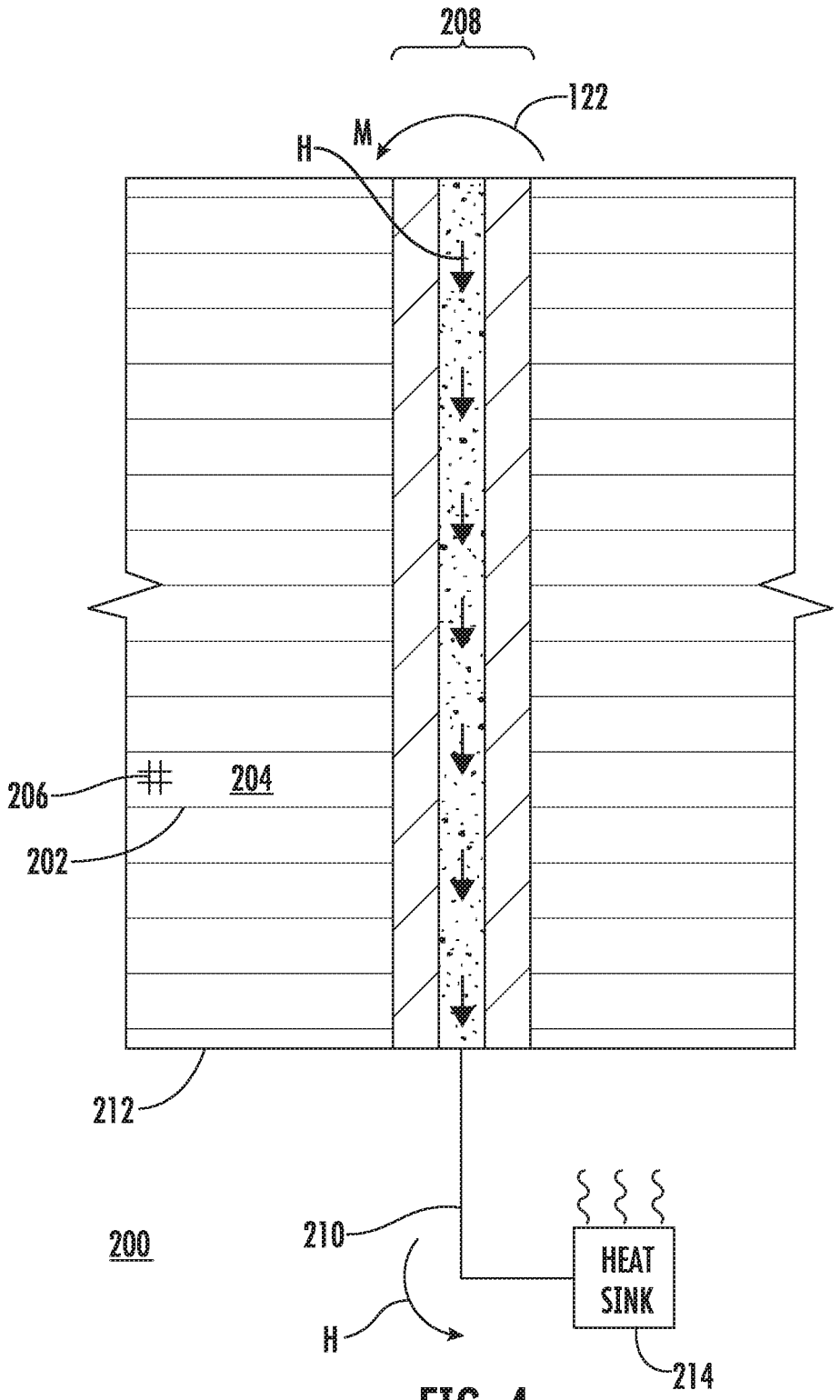
FIG. 4 is partial cross section view of the inductor of FIG. 1, showing insulators arranged within the gap and heat being communicated through a spacer arranged in the gap to a heat sink according to an another exemplary embodiment having a layers core construction.

Referring now to FIG. 4, magnetic core 200 is shown according to another exemplary embodiment having a layered construction 202. As used herein the term layered means that magnetic core 200 includes wound, stacked, layered and/or laminated sheets within its respective core segments. More particularly, the ferromagnetic material 105 (shown in FIG. 2) included in magnetic core 100 is formed from a plurality of sheets 204. Sheets 204 can be formed from an electric steel material 206, which is amendable to stamping and laminating to form relative complex core shapes (e.g., non-toroid shaped). As will be appreciated by those of skill in the art in view of the present disclosure, use layered construction 202 can reduce the cost of fabricating magnetic core 200. As will also be appreciated by those of skill in the art in view of the present disclosure, layered construction 202 can be more sensitive to the return angle of magnetic flux lines 122 due to the interface proximate (i.e., under) the location where magnetic flux lines 122 return to second core segment 106 where the outer sheet is joined to the inner sheets. Layered construction 202 thereby aggravates the tendency of heat H to be generated at the return location.

To limit the magnitude of heat H associated with the return of magnetic flux lines 122 to the location adjacent gap 208, magnetic core 200 is also thermally grounded. In this respect magnetic core 200 with layered construction 202 also includes a thermal ground 210 connecting second core segment 212 to a heat sink 214 through spacer 216 and second insulator 218. Connectivity to heat sink 214 allows for communication of heat H to heat sink 214, preventing heat H from locally changing permeability of magnetic core 200 and potentially extending the use of layered construction 202 to applications where current flow i (shown in FIG. 1) could otherwise preclude the use of layered construction 202.

Figure 5:
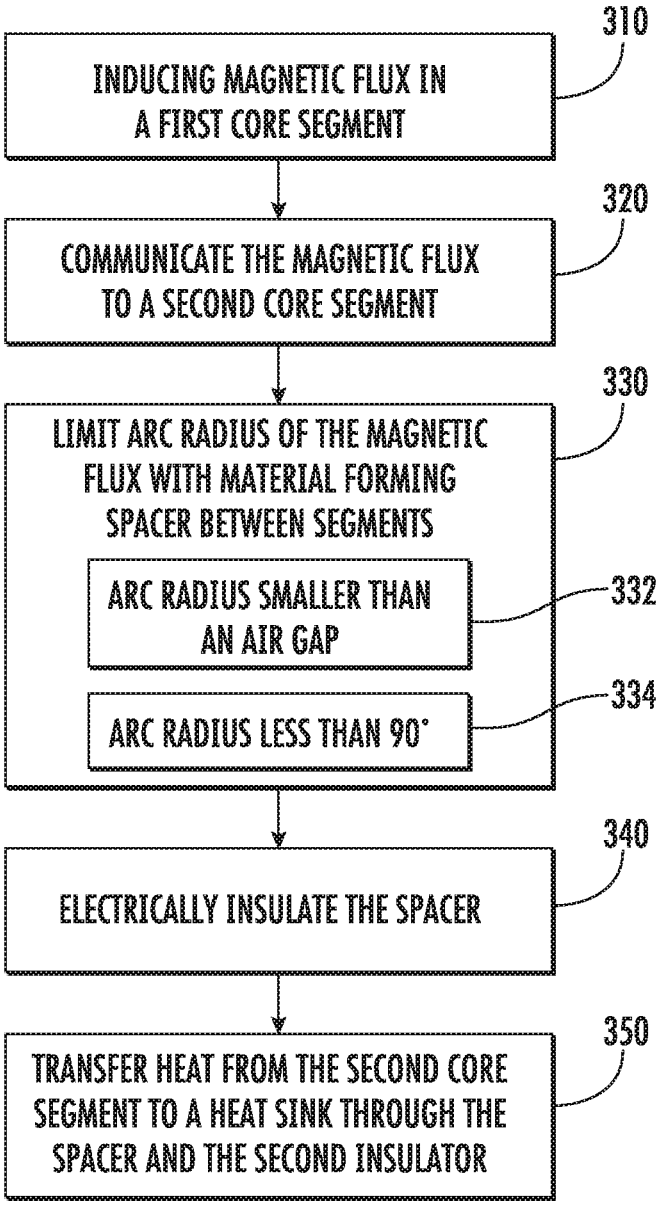
FIG. 5 is a block diagram of a power conversion method using a flyback transformer or a transformer rectifier unit having the inductor of FIG. 1, showing steps of the method.

With reference to FIG. 5, a power conversion method 300 is shown. Power conversion method 300 includes, at an inductor having a magnetic core, e.g., magnetic core 100 (shown in FIG. 1) or magnetic core 200 (shown in FIG. 4), inducing magnetic flux, e.g., magnetic flux M (shown in FIG. 2), as shown with box 310. The magnetic flux is communicated from the first core segment, e.g., first core segment 104 (shown in FIG. 1), to the second core segment 106 (shown in FIG. 1), shown with box 320. The arc radius of the magnetic flux lines is limited by the material forming the spacer located between the first core segment and the second core segment, e.g., semi-conductive material 112 (shown in FIG. 2), as shown with box 330.

It is contemplated that the magnetic flux lines have an arc radius smaller than that of an air gap having similar reluctance, as shown with box 332. It is also contemplated that the magnetic flux lines have an arc radius that is less than 90 degrees, as shown with box 334. In this respect the radius of lines of magnetic flux returning to the second core segment from the first segment can be less than an air spacer or aluminum spacer of substantially equivalent reluctance. Further, in certain embodiments, the spacer can be electrically separated from the second core segment with an insulator, as shown with box 340. Heat can be transferred from the location where the lines of magnetic flux return to the core through a heat sink thermally coupled to the second core segment by the spacer, as shown with box 350.

Gap losses related to large fringing flux in cut toroidal inductors can cause excessive heating. The magnetic field radiated outward can also cause additional losses in the housing containing the inductor. This magnetic field is radiated radially outward due to the reluctance of air or similar gap material. One approach to limit the impact of fringing flux is to increase the number of gaps and make each gap relatively small in width, thereby reducing the reluctance at each gap. While generally acceptable for its intended purpose, small gaps tend to cause the fringing flux to re-enter the core material at an angle perpendicular to the core due to the gap width, resulting in heating. Another approach is to construct the spacer from a low reluctance material, such as aluminum. While generally acceptable, aluminum tends to develop eddy currents in the spacer, which limits the effectiveness of the spacer as energy level increases.

In embodiments described herein a semi-conductive material is inserted into the gaps of the inductor. The semi-conductive material reduces the reluctance of the gap and directs the lines of flux associated with the fringing flux. In accordance with certain embodiments, the spacer material can have a reluctance substantially equivalent to the material forming the core, thereby limiting the arc radius of the fringing flux and causing a relatively large proportion of th magnetic flux to be communicated through the spacer rather than radially outward of the spacer. It is also contemplated that the spacer can be used to thermally shunt heat generated by the returning flux to a heat sink. This can result in both a weight reduction and lower operating temperature of the inductor owing to the use of the semi-conductive material forming the spacer.

The methods and systems of the present disclosure, as described above and shown in the drawings, provide for gapped core bodies with superior properties including small arc radius of magnetic flux lines radiated outward of the core proximate the gap between core segments of a segmented core. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A magnetic core for an inductor, comprising:

a multiple core segments, adjacent core segments of the multiple core segments spaced apart from one another by respective gaps of at least two gaps;

a spacer arranged within each gap and between the adjacent core segments, wherein the spacer includes a semi-conductive material to limit arc radius of magnetic flux lines communicated outside of the gap and between the adjacent core segments; and a winding extending about the multiple core segments and the spacers associated with each gap, wherein radial separation between the winding and each of the spacers is substantially equivalent to a radial separation that is provided between the winding and at least one of the core segments between which the spacer is arranged.

2. The magnetic core as recited in claim 1, wherein the magnetic core has a toroid shape.

3. The magnetic core as recited in claim 1, wherein at least one of the first core segment and the second core segment include a ferromagnetic material.

4. The magnetic core as recited in claim 1, wherein the core has a monolithic construction.

5. The magnetic core as recited in claim 1, wherein the core has a layered construction.

6. The magnetic core as recited in claim 1, wherein the semi-conductive material includes aluminum nitride.

7. The magnetic core as recited in claim 1, wherein the spacer is electrically isolated from the first core segment, wherein the spacer is electrically isolated from the second core segment.

8. The magnetic core as recited in claim 1, further comprising an insulator arranged between the spacer and the first core segment.

9. The magnetic core as recited in claim 7, wherein insulator is a first insulator and further comprising a second insulator, wherein the second insulator is arranged between the spacer and the second core segment.

10. The magnetic core as recited in claim 1, further comprising a thermal ground connection coupling the second core segment to a heat sink through the spacer to limit heating of the second core segment at a location where magnetic flux exiting the magnetic core from first core segment returns to the second core segment.

11. An inductor including the magnetic core as recited in claim 1, further comprising:

a first insulator arranged between the spacer and the first core segment;

a second insulator arranged between the spacer and the second core segment;

a thermal ground connecting the second core segment to a heat sink through the spacer and the second insulator.

12. The inductor as recited in claim 11, wherein arc radius of magnetic lines of flux entering the second core segment from the first core segment are smaller than arc radius of magnetic flux entering the second core segment with an air spacer or aluminum spacer of substantially equivalent reluctance.

13. A flyback transformer or transformer rectifier unit (TRU) including an inductor as recited in claim 11.

14. The flyback or TRU as recited in claim 13, wherein the flyback transformer or TRU is configured and adapted to convert 120 voltage alternating current power into 28 volt direct current power.

15. A power conversion method, comprising:

at a magnetic core with multiple core segments, adjacent core segments of the multiple core segments spaced apart from one another by respective gaps of at least two gaps, a spacer arranged within each gap and between the adjacent core segments, wherein the spacer includes a semi-conductive material to limit arc radius of magnetic flux lines communicated outside of the gap and between the adjacent core segments, and a winding wrapped about the multiple core segments and the spacers associated with each gap, wherein radial separation between the winding and each of the spacers is substantially equivalent to a radial separation that is provided between the winding and at least one of the core segments between which the spacer is arranged;

inducing magnetic flux in the first core segment;

communicating the magnetic flux to the second core segment; and limiting arc radius of magnetic flux lines returning to the second core segment with the semi-conductive material forming the spacer.

16. The method as recited in claim 15, wherein arc radius of lines of magnetic flux returning to the second core segment from the first segment is less than an air spacer or aluminum spacer of substantially equivalent reluctance.

17. The method as recited in claim 15, further comprising electrically separating the spacer from the second core segment with an insulator.

18. The method as recited in claim 15, further comprising transferring heat from the location where the lines of magnetic flux return to second core segment through a heat sink thermally coupled to the second core segment by the spacer.

* * * * *